US007090252B2

(12) United States Patent
Manico et al.

(10) Patent No.: US 7,090,252 B2
(45) Date of Patent: Aug. 15, 2006

(54) FOLDED INTEGRAL COMPOSITE IMAGE PRODUCT AND METHOD OF MAKING

(75) Inventors: Joseph A. Manico, Rochester, NY (US); Dale F. McIntyre, Honeoye, NY (US); John K. McBride, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/392,075

(22) Filed: Mar. 19, 2003

(65) Prior Publication Data

US 2003/0178839 A1 Sep. 25, 2003

Related U.S. Application Data

(62) Division of application No. 09/593,645, filed on Jun. 13, 2000.

(51) Int. Cl.
*B42D 3/00* (2006.01)

(52) U.S. Cl. ..... 281/46; 281/22; 281/29; 281/31; 281/34; 281/38; 281/51; 283/34; 283/38; 283/106; 283/117; 402/79; 402/80 R; 412/1; 412/7; 412/33; D19/33; 434/308; 434/311; 434/317; 355/64; 355/72; 355/133; 40/124.09; 40/124.11; 40/124.12; 40/156; 40/376; 40/395; 40/661; 40/661.06; 40/704; 40/725; 40/726; 40/750; 40/768; 40/774; 40/790; 40/791; 40/904; 24/67 R; 24/67.3; 24/67.5; 24/67.11

(58) Field of Classification Search ..... 281/22, 281/31, 29, 34, 38, 51, 46; 283/38, 34, 117, 283/106; 402/79, 80 R; 412/1, 7, 33; D19/33; 434/308, 311, 317; 355/64, 72, 133; 40/124.09, 40/124.11, 124.12, 661, 661.06, 376, 726, 40/395, 156, 704, 725, 750, 790, 791, 768, 40/774, 904; 24/67 R, 67.3, 67.5, 67.11
See application file for complete search history.

(56) References Cited

U.S. PATENT DOCUMENTS 1,304,773 A * 5/1919 Howell ..... 446/149
1,772,338 A * 8/1930 Cherry ..... 40/774
3,738,686 A * 6/1973 Morse ..... 283/63.1
4,183,162 A * 1/1980 Applebaum et al. ..... 40/530
4,350,195 A * 9/1982 Viesturs et al. ..... 150/147
4,704,042 A * 11/1987 Eisen et al. ..... 402/79
4,720,733 A * 1/1988 Ohtake et al. ..... 355/50
5,029,902 A * 7/1991 Komori ..... 283/56
5,030,027 A * 7/1991 Bachrach et al. ..... 402/4
5,160,170 A * 11/1992 Ferra ..... 283/35
D376,176 S * 12/1996 Buraczynski ..... D19/26
5,622,384 A * 4/1997 Bradley ..... 281/2
5,636,872 A * 6/1997 Gamer et al. ..... 283/49
5,655,866 A * 8/1997 Bellanca ..... 412/1
5,749,667 A * 5/1998 Feldman et al. ..... 402/79
5,791,692 A 8/1998 Manico et al.
5,815,964 A * 10/1998 Douglas ..... 40/124.12
5,836,622 A * 11/1998 Fabel ..... 283/62
5,890,741 A * 4/1999 Hollander ..... 283/62
5,957,502 A 9/1999 Manico et al.
6,004,061 A 12/1999 Manico et al.
6,076,989 A * 6/2000 Pearce et al. ..... 402/70
6,135,662 A * 10/2000 Bakke et al. ..... 402/73
6,135,663 A * 10/2000 Tan ..... 402/79
6,164,859 A * 12/2000 Hambright ..... 402/73
6,196,750 B1 * 3/2001 Hansen ..... 402/79
6,276,723 B1 * 8/2001 Willard ..... 283/34
6,293,592 B1 * 9/2001 Robertson et al. ..... 283/117
2002/0015019 A1 * 2/2002 Kinjo ..... 345/156
2002/0195189 A1 * 12/2002 Allen et al. ..... 156/217
2003/0075917 A1 * 4/2003 Frosig et al. ..... 281/21.1
2003/0111183 A1 * 6/2003 Archie et al. ..... 156/461

* cited by examiner

*Primary Examiner*—Boyer Ashley
*Assistant Examiner*—Mark Henderson
(74) *Attorney, Agent, or Firm*—Frank Pincelli

(57) ABSTRACT

A dual sided integral composite image product and method of make same. The image product includes a first support substrate having a separate image layer thereon and a second support substrate having separate image layer thereon. The second support substrate being secured to the first support substrate so as to form the dual sided integral composite image product. A fold line is provided on said image product about which the integral composite image product may be folded.

2 Claims, 13 Drawing Sheets

FOLDED INTEGRAL COMPOSITE IMAGE PRODUCT AND METHOD OF MAKING

CROSS-REFERENCE TO RELATED APPLICATIONS

This is a divisional of application Ser. No. 09/593,645, filed Jun. 13, 2000 in the names of Joseph A. Manico, et al.

FIELD OF THE INVENTION

The present invention relates to image products. In particular to image products having images on both sides and which are folded.

BACKGROUND OF THE INVENTION

It is well known to provide photographic prints which are typically displayed in the form produced or placed into a mounting structure such as a frame or album. These mounting structures help maintain the integrity of the photographic print preventing damage to the print caused by inadvertent bending or folding of the print. Folding of the print causes the photographic emulsion to crack and thus destroy the appearance of the print.

An additional problem with the display of photographic prints is the size of the mounting structures are required to be larger than the photographic print. This is especially true with oversize photographic prints such as posters, panoramic prints, or enlargements. Thus the prints must be stored in an area that is larger than the original print.

Another problem with the prior art is the difficulty with storing a collection of different size photographic prints in a single storage structure. In the prior art the album is at least as large as the largest print contained therein. Thus there is a need to provide a structure that allows the compact storage of images of various sizes.

It is known in the prior art to provide dual sided album pages such as disclosed in U.S. Pat. Nos. 5,791,692; 5,957,502; and 6,004,061. However, the display of images on these pages is limited to the size of the single folded album page.

Thus, there is a need to provide a improved photographic image product and method of making same to minimize or avoid the problems of the prior art.

SUMMARY OF THE INVENTION

In accordance with one aspect of the present invention there is provided a method for making a dual sided composite image product, comprising the steps of:

providing a first support substrate having a first side and a second side, said first side having an image layer separate from said substrate;

providing a second support substrate having a first side and a second side, said first side having an image layer separate from said substrate;

securing said first substrate to said second substrate so as to form a composite image product;

forming a fold line on said composite image product; and folding composite image product about said fold line.

This and other aspects, objects, features and advantages of the present invention will be more clearly understood and appreciated from a review of the following detailed description of the preferred embodiments and appended claims, and by reference to the accompanying drawings.

BRIEF DESCRIPTION OF THE DRAWINGS

In the detailed description of the preferred embodiments of the invention presented below, reference is made to the accompanying drawings in which.

DETAILED DESCRIPTION OF THE INVENTION

Figure 1:
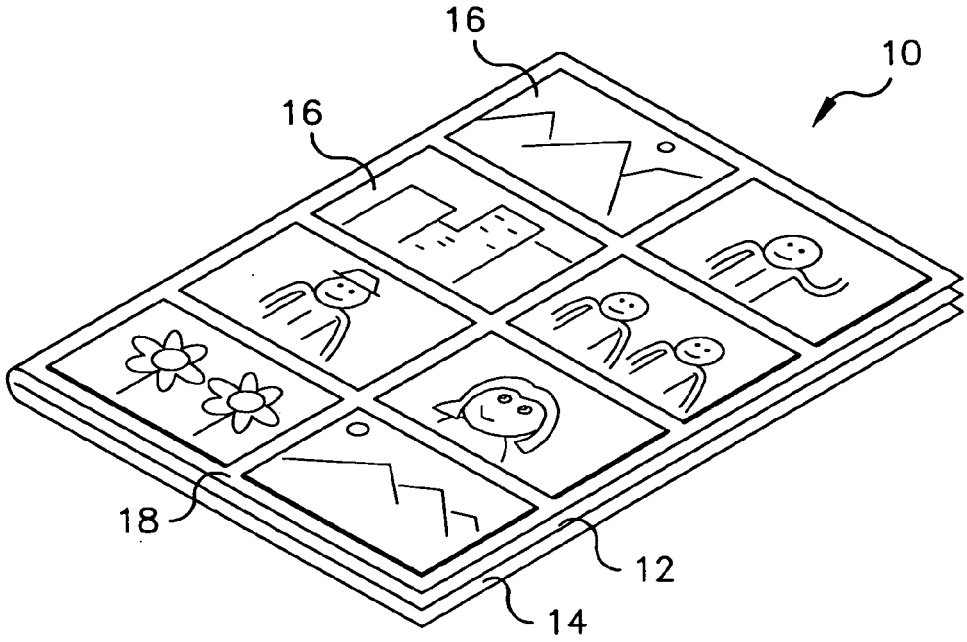
FIG. 1 is perspective view of an integral composite image product made in accordance with the present invention.
Figure 2:
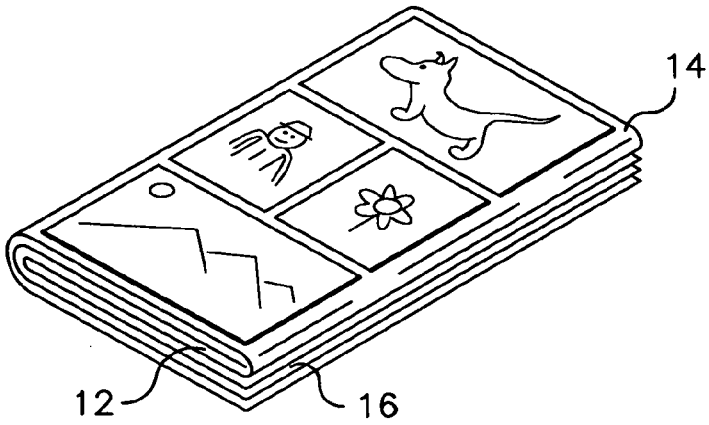
FIG. 2 is a perspective view of the integral composite image product of FIG. 1 folded in accordance with the present invention.

Referring to FIGS. 1 and 2, there is illustrated an integral composite image product 10 made in accordance with the present invention. In the particular embodiment illustrated, the integral composite image product 10 comprises an album page (leaf) such as disclosed in U.S. Pat. Nos. 5,791,692; 5,957,502; and 6,004,061. The integral composite image product 10 comprises a first substrate 12 and a second substrate 14 each having an emulsion layer thereon upon which images 16 may be provided. In the particular embodiment illustrated, the first and second support substrates 12, 14 are made from a single sheet of media that has been folded back upon itself as more fully described in U.S. Pat. Nos. 5,791,692; 5,957,502; and 6,004,061 which are hereby incorporated by reference. However, the present invention is not so limited. If desired the two substrates may each comprise a cut sheet, the cut sheets secured together so as to form an integral composite structure 10. In the particular embodiment illustrated, the support substrates 12, 14 comprise photographic media having an emulsion layer thereon capable of receiving and retaining images as is typical with prior art photographic paper. Since the emulsion layer is separate from the support substrates 12,14 when the substrates 12, 14 are folded, care must be taken to minimize any potential damage to the image formed thereon. As is typical with prior art photographic paper, they are not designed to be folded.

With the advent of digital printing, it is now possible to compose images on photographic paper in any combination of desired sizes and formats. This now has allowed for the easy production of album pages as described in the above referenced patents.

Figure 11:
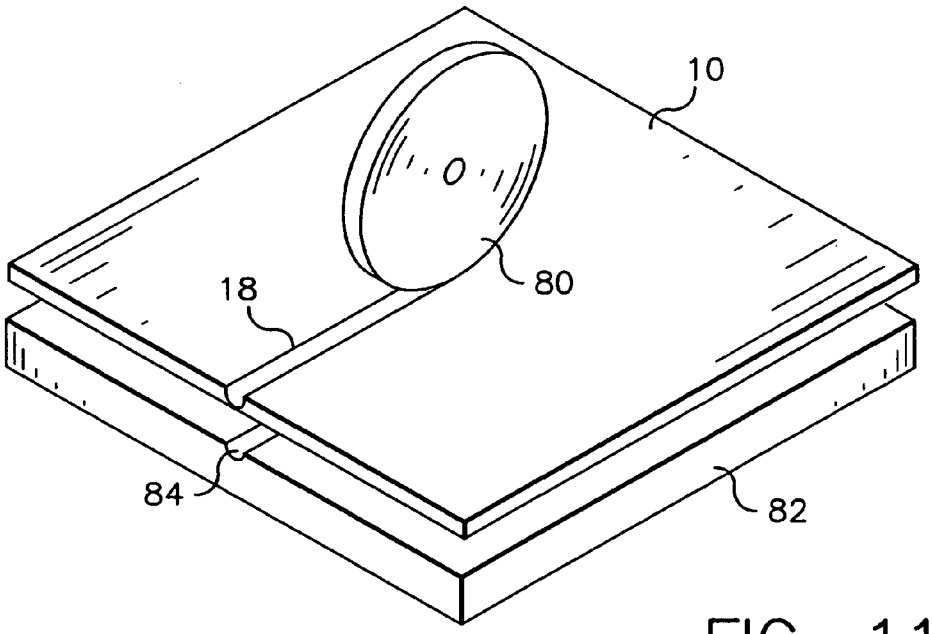
FIG. 11 is a perspective view illustrating how the fold line may be made.

The album page 10 is provided with a fold line 18 for allowing folding and unfolding of the album page 10 for allowing viewing of the images 16 contained within the folded section. FIG. 2 illustrates the album page 10 in the folded position. The fold line 18 is constructed in such a manner so as to minimize potential damage to the images 16 thereon. Referring to FIG. 11, there is illustrated an enlarged view of the fold line 18 and how it may be made. In particular, the fold line 18 may be made using a embossing disc 80 and mating die 82. The embossing disc 80 is preferably placed on the side of the album page 10 which forms the inside of the folded album page 10. The fold line 18 is preferably constructed so as to provide a hinge that allows the support substrates 12,14 to be repeatably folded and unfolded. In the particular embodiment illustrated, the album page 10 is shown as a free standing product. However, the album page 10 may be provided with means for securing the album page 10 in an album as is discussed later herein.

Figure 3:
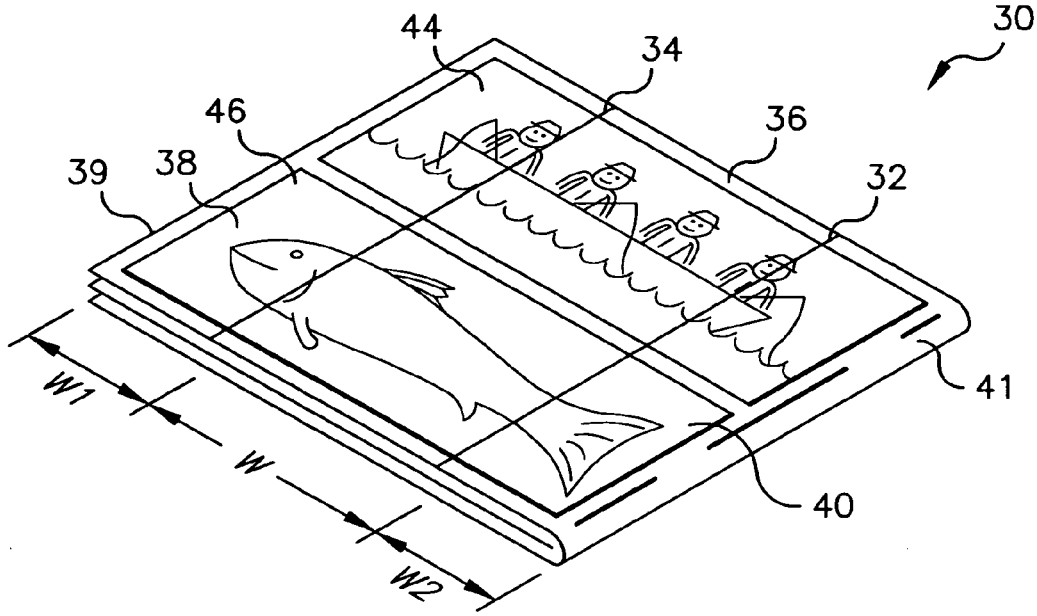
FIG. 3 is a perspective view of a modified integral composite image product made in accordance with the present invention.
Figure 4:
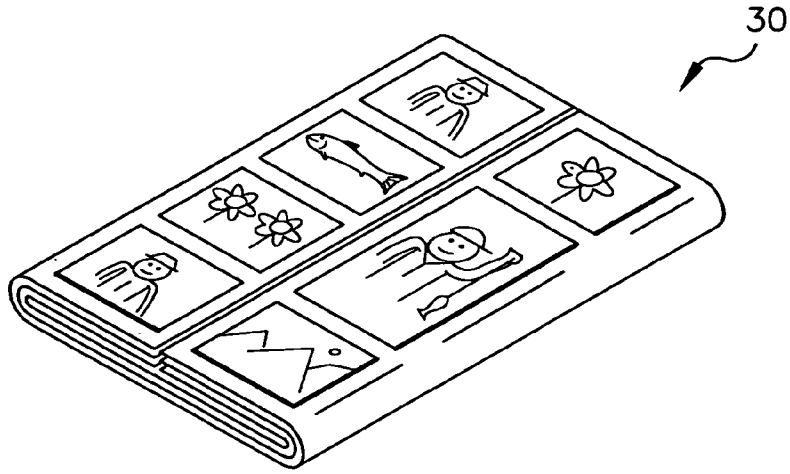
FIG. 4 is a perspective view of the folded integral composite image product of FIG. 3.

Referring to FIGS. 3 and 4, there is illustrated another image product 30 made in accordance with the present invention like numerals indicating like parts and operation as previously discussed. In this embodiment, there is provided a pair of fold lines 32, 34 which are each similar in construction to fold line 18 as previously discussed. The fold lines 32 and 34 divide the image product into three sections: a central section 36, a first side section 38 and second side section 40, the central section being positioned between the two side sections 38, 40. In the embodiment illustrated, the central section 36 has a width W and each of the side sections 38 have a width W1 and W2 respectively. In the embodiment illustrated, the width W1 and W2 are such that when in the folded position as illustrated in FIG. 4 substantially the entire width W of central section 36 is covered. Thus the ends 39, 41 of side sections 38, 40, respectively substantially abut. Preferably, the fold line abutting occurs approximately in the center of center section 36. As best illustrated by reference to FIG. 3, large images 44, 46 which extend across each of the sections 36, 38, 40 are fully viewable when the image product 30 is in the unfolded state.

Figure 5:
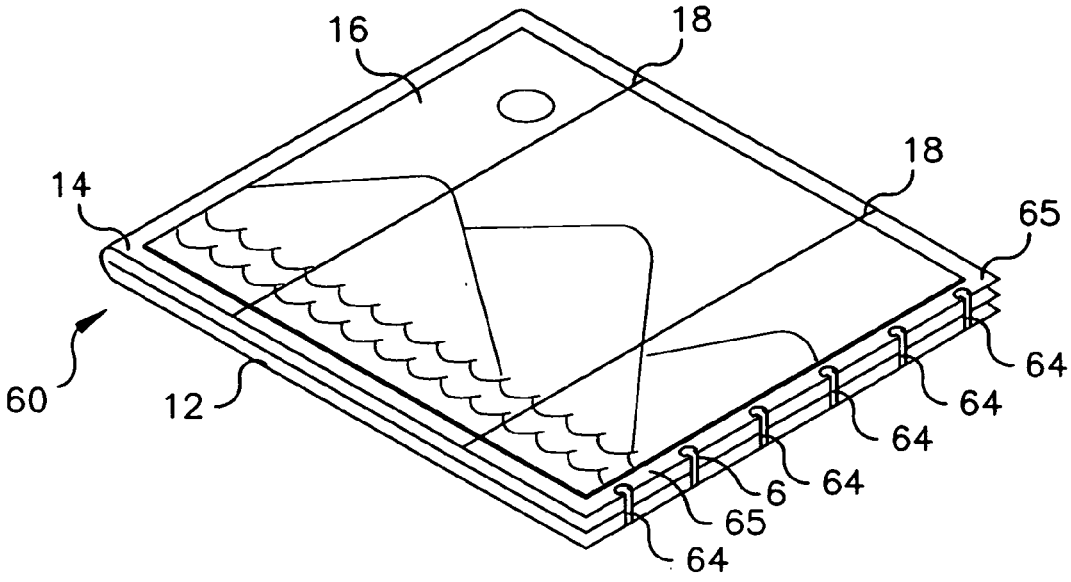
FIG. 5 is a perspective view of another modified album leaf made in accordance with the present invention in the unfolded condition.
Figure 6:
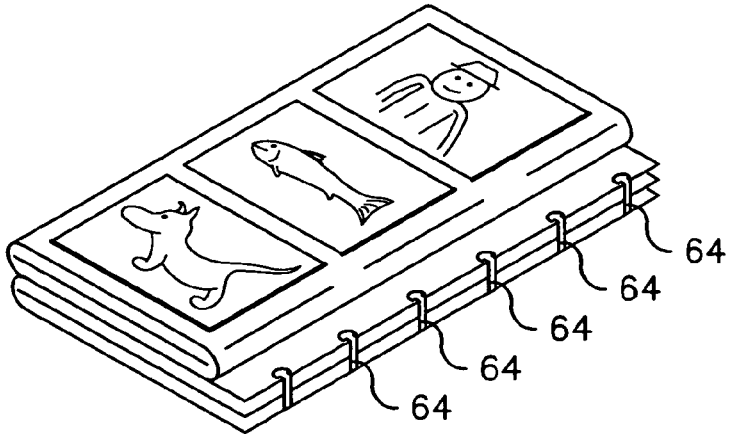
FIG. 6 is a perspective view of the album leaf of FIG. 5 in the folded condition.

Referring to FIGS. 5–10 there is illustrated another modified image product 60 made in accordance with the present invention like numerals indicating like parts and operations as previously discussed. In the embodiment illustrated, image product 60 comprises an album leaf. FIG. 5 illustrates the image product 60 in the unfolded state and FIG. 6 illustrates the product 60 in the folded state. As illustrated, the product 60 has a pair of spaced fold lines 61, 63 forming sections 71, 73, and 75. The fold lines 61, 63 are such that the product 60 is provided with a "Z" type fold so that the product 60 can fit within the album cover 62.

Figure 7:
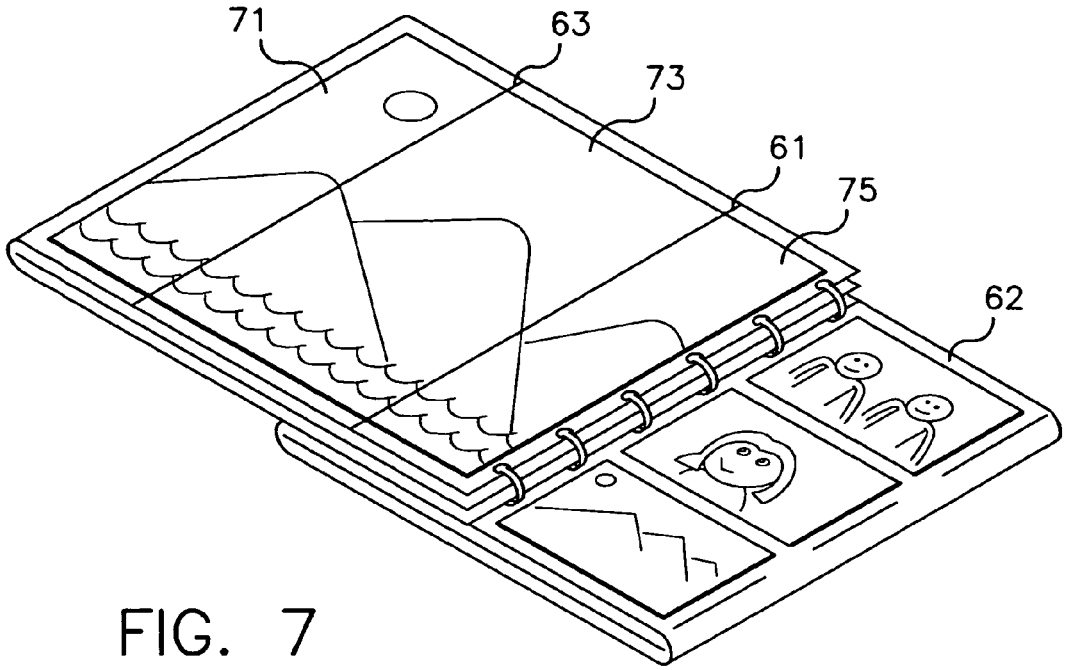
FIG. 7 is a perspective view of album leaf of FIGS. 5, 6 provided in the unfolded condition as mounted in an album cover.
Figure 8:
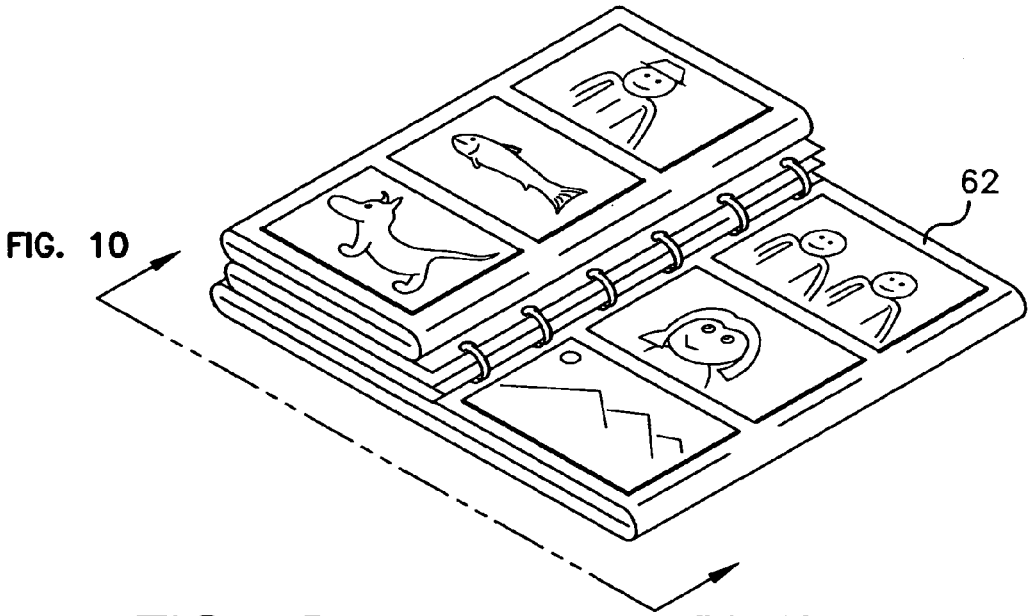
FIG. 8 is a perspective view similar to FIG. 7 illustrating the album leaf in the folded state.

FIG. 7 illustrates the image product 60 in the unfolded state secured to album cover 62 for viewing of the images 16 thereon. FIG. 8 illustrates the image product 60 in the folded stated so that the album cover 62 may be closed.

The product 60 is provided with means for attaching or removing the product 60 from an album cover 62 as illustrated by FIGS. 7 and 8. In particular image product 60 is provided with a plurality of mounting openings 64 in a marginal area 65 of the product 60. The marginal area 65 is preferably provided to avoid placing the openings 64 within the area containing images 16. The openings 64 are each designed to be releasably secured to an attaching member 66 provided in album cover 62. In the embodiment illustrated, the album cover 62 is constructed in such a manner illustrated by FIG. 1 so that images can be provided on the inside and outside surfaces of the album cover 62. The images on the album cover 62 may compliment the images provided on the image product 60 secured to the album cover 62.

Figure 9A:
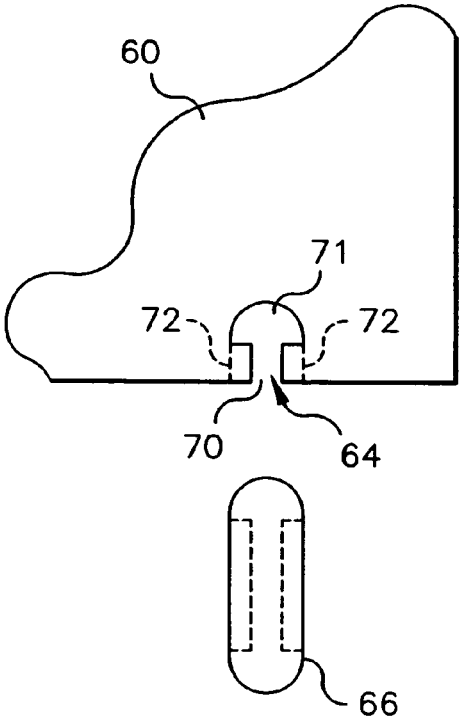
FIGS. 9*a*, 9*b*, 9*c*, 9*d* are enlarged partial views of the leaf of FIG. 7 illustrating how one of the openings may be mounted to the album cover.
Figure 9B:
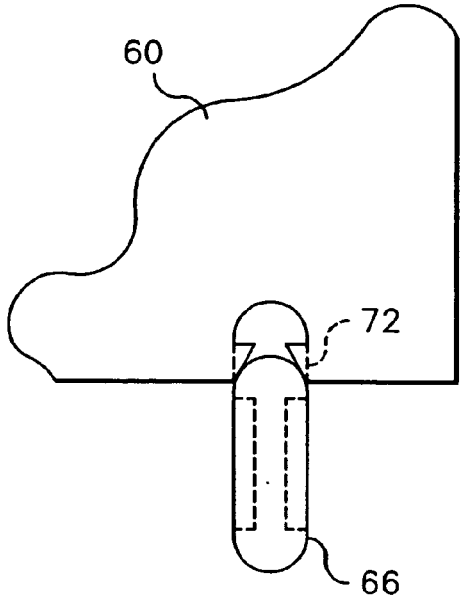
Figure 9C:
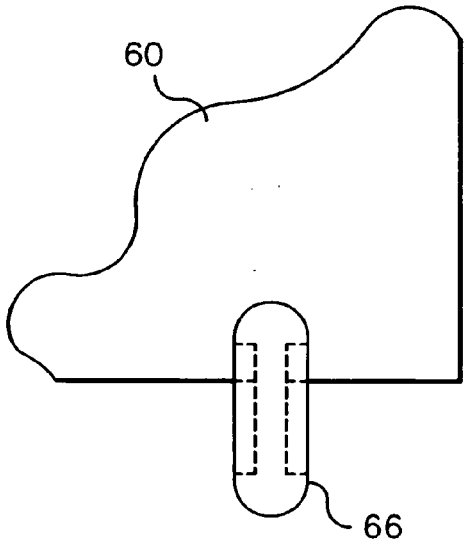
Figure 9D:
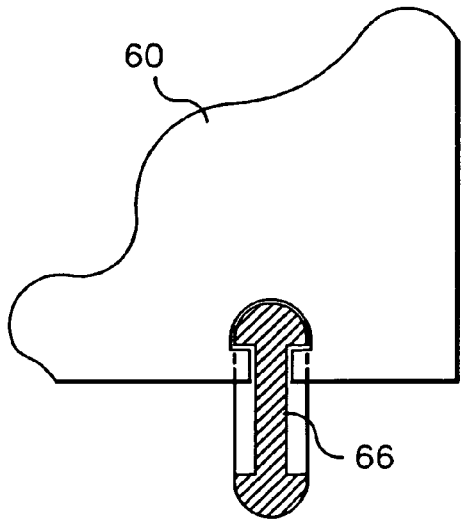
Figure 10:
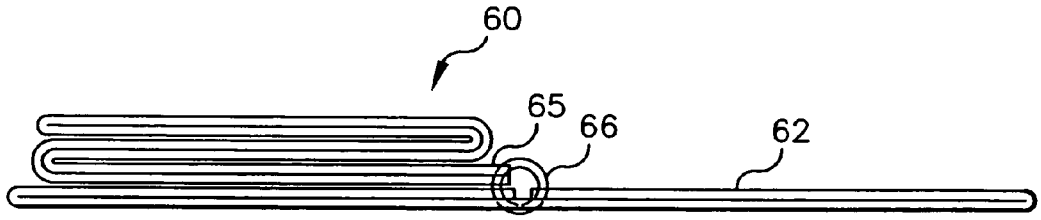
FIG. 10 is a side elevational view of the album leaf and cover of FIG. 8 as taken along the line 10—10.

Referring to FIGS. 9*a*–9*d*, there is illustrated a sequence of views illustrating in greater detail one of the openings 64 and how the product 60 may be attached to attachment member 66. Preferably, as illustrated, the opening 64 has a general mushroom shaped configuration having a large retaining section 69 and a narrower connecting opening 70. A pair of score lines 72 are provided adjacent opening 64 so as to provide a degree of flexibility to the area surrounding connecting section 70. FIG. 9*a* illustrates the image product 60 prior to attachment. FIG. 9*b* illustrates the image product 60 as it is initially contacting attachment member 66. FIGS. 9*c* and 9*d* illustrate the image product 60 secured to attachment member 66. To remove the image product 60, the image product 60 is simply pulled away from the attachment member 66.

It is of course to be understood that any desired means may be used for attaching the image product 60 to the album cover 62. For example, but not by way of limitation, holes may be provided in a marginal area 65 which could engage rings provided in cover 62. Optionally, the album cover 62 may be omitted and a plurality of leafs 60 could be simply secured to one or more rings.

Referring to FIG. 11 there is illustrated one method in which the fold line as previously discussed may be formed in any of the previously discussed image products made according to the present invention. FIG. 11 illustrates fold line 18 being formed in product 10. A embossing disc 80 is provided and is moved relative to image product 10. Disposed on the opposite side of product 10 there is provided a die 82 having a groove 84. The embossing disc 80 is pressed against the product 10 and is positioned to engage the groove 84. A sufficient degree of force is applied against the product 10 by embossing disc 80 such that a fold line 18 is produced as illustrated by FIG. 12.

Figure 12:
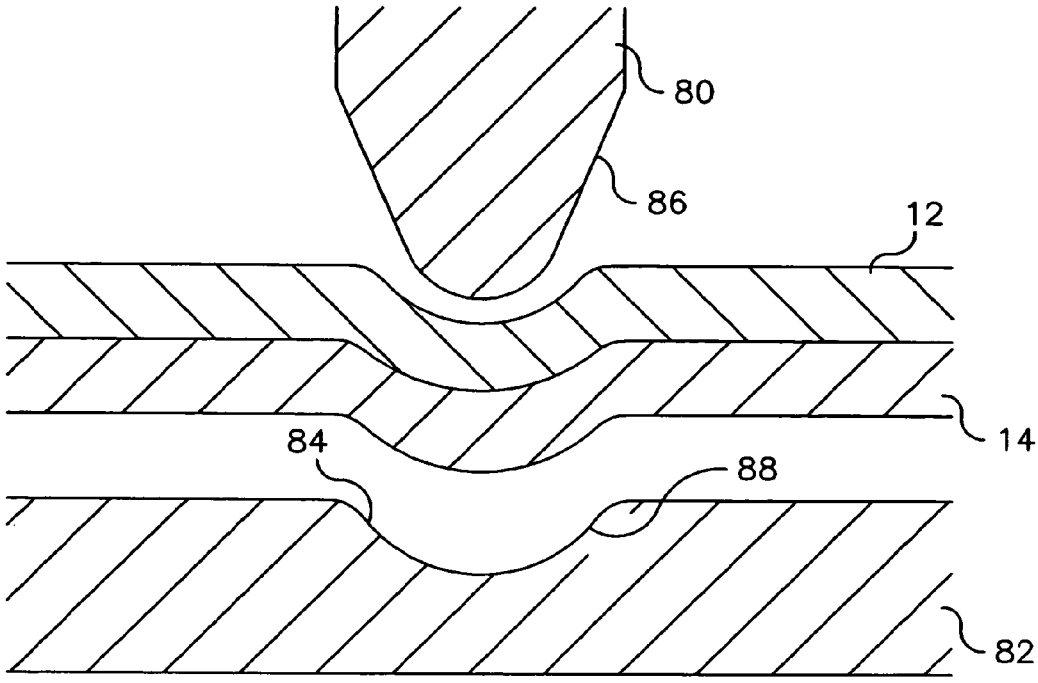
FIG. 12 is an enlarged view of the fold area illustrated in FIG. 11.

As can be best seen by FIG. 12, the embossing disc 80 has an engaging surface 86 having a cross section profile so as to minimize damage to the product 10 yet produce a flexible hinge. The groove 84 has an inner surface 88 which corresponds generally to the configuration of surface 86. The shape of surfaces 86, 88 will vary depending upon on the characteristics of the substrate being folded. When photographic media with plastic substrates, such as Kodak Duralife™ photographic paper manufactured by the Eastman Kodak Company or Kodak Image Magic Paper™ (thermal media) also manufactured by the Eastman Kodak Company, are being used, the surfaces 86, 88 are smooth and curved so as to minimize potential damage to the substrate and images thereon. With these type of materials, there is little or no need to score or cut the substrate opposite the substrate to which the embossing disc 80 is applied.

Figure 13:
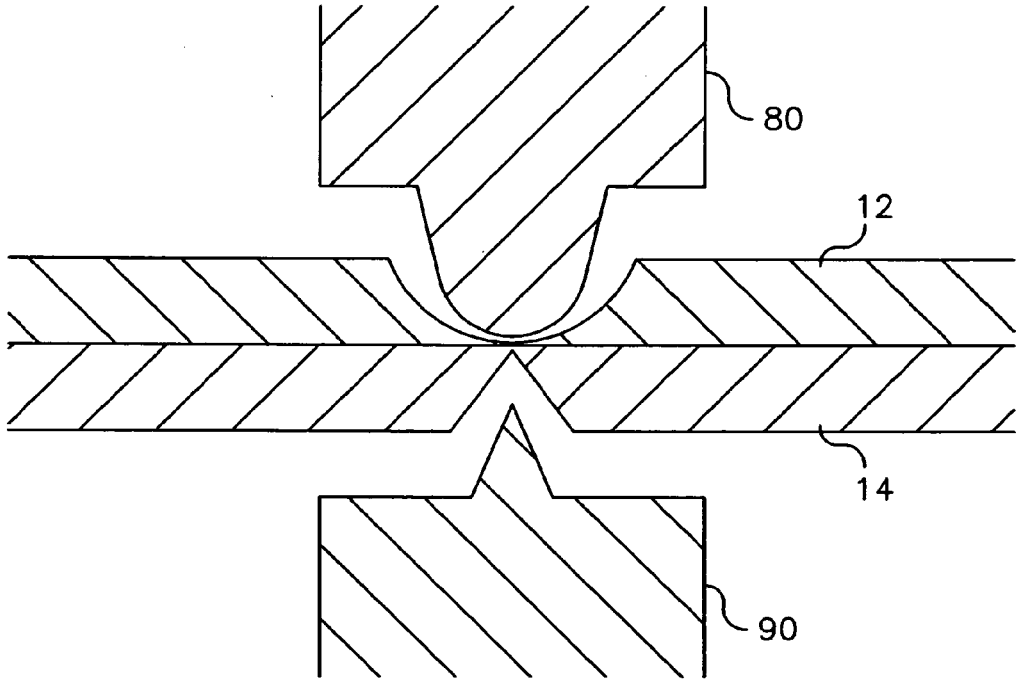
FIG. 13 is an enlarged cross sectional view illustrating another method by which the fold line may be produced.

When fiber-based media such as photographic paper is being used, the fold line 18 is produced by embossing disc 80 for producing an embossed crease in the adjacent substrate 12 and an opposed cutting tool 90 for producing a cut in the adjacent substrate 14 as illustrated by FIG. 13. Preferably, the embossing disc 80 is applied to the side of the product 10 which folds inside. For example, embossing disc 80 is applied against substrate 12 of product 10 as shown in FIG. 1. Likewise, cutting tool 90 is applied against the opposing substrate 14 of product 10. This same technique can be applied to the "Z" fold product 60 shown in FIG. 6.

Figure 14:
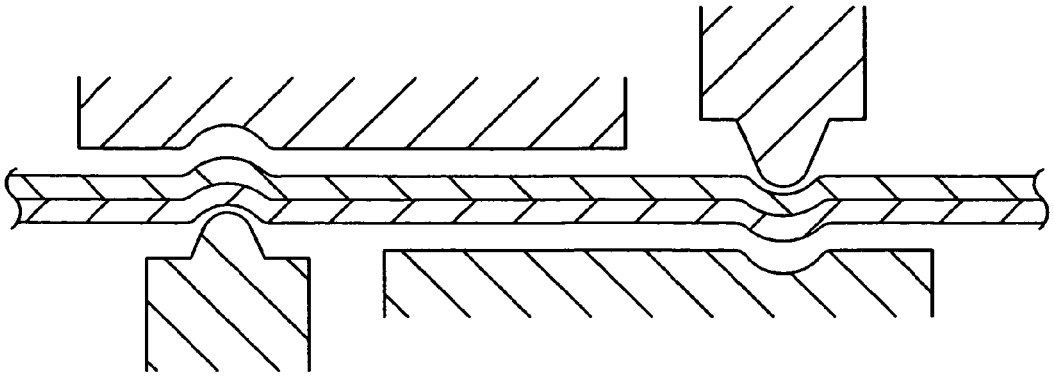
FIG. 14 is an enlarged cross sectional view illustrating how the fold lines of the album leaf of FIG. 5 may be formed.

In FIG. 14, a plurality of embossing discs 80 are provided on opposite sides of product 10 to compensate for the folding of the product 10 in different directions. It is to be understood that various other techniques can be used for forming fold lines, for example, but not limited to, the use of an embossing bar and die in place of embossing disc 80 and associated die 82. Additionally, heat may be applied to the embossing disc 80 and/or die 82 for improving the fold characteristics of product 10 and forming a flexible hinge in plastic media.

Figure 17A:
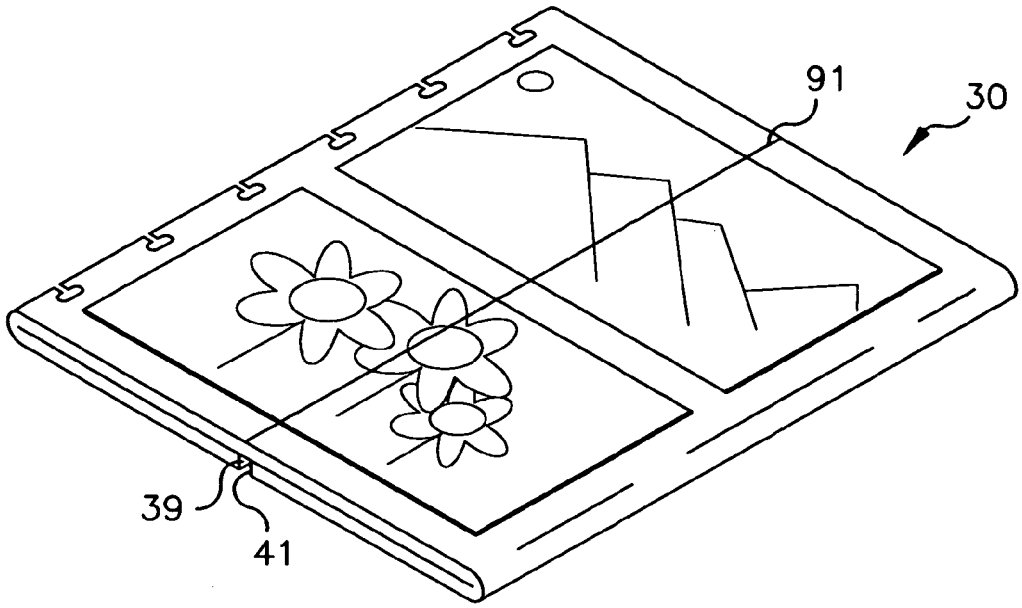
FIGS. 17*a*–*b* are perspective views which illustrate yet another modified image product made in accordance with the present invention
Figure 17B:
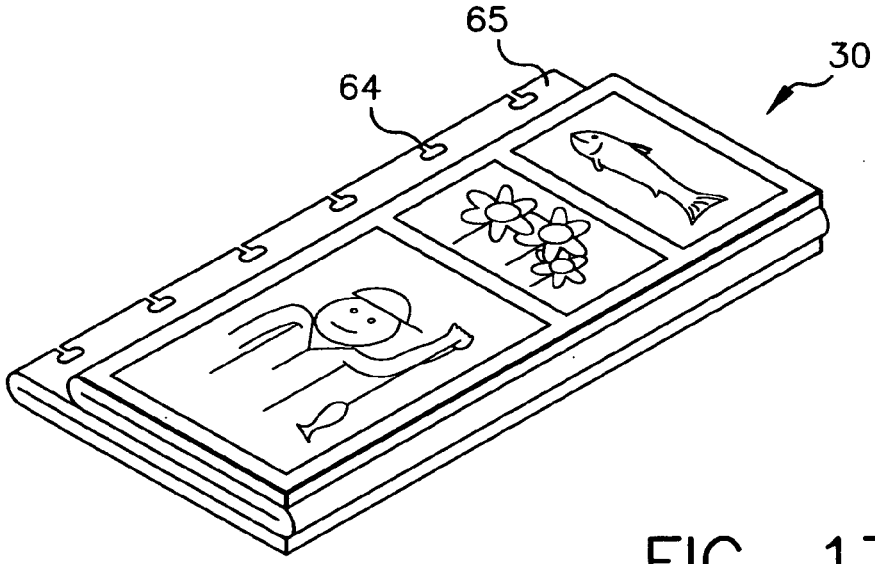

In the embodiment illustrated in FIGS. 17*a*–*b*, like numerals indicating like parts and operation as previously discussed, only a single embossed crease 91 is needed on the side of the image product 30 disposed on the opposite side of the abutting edges 39, 41. This is due to the fact that the ends 39 41 provide a inherent folding area on the one side.

Figure 15A:
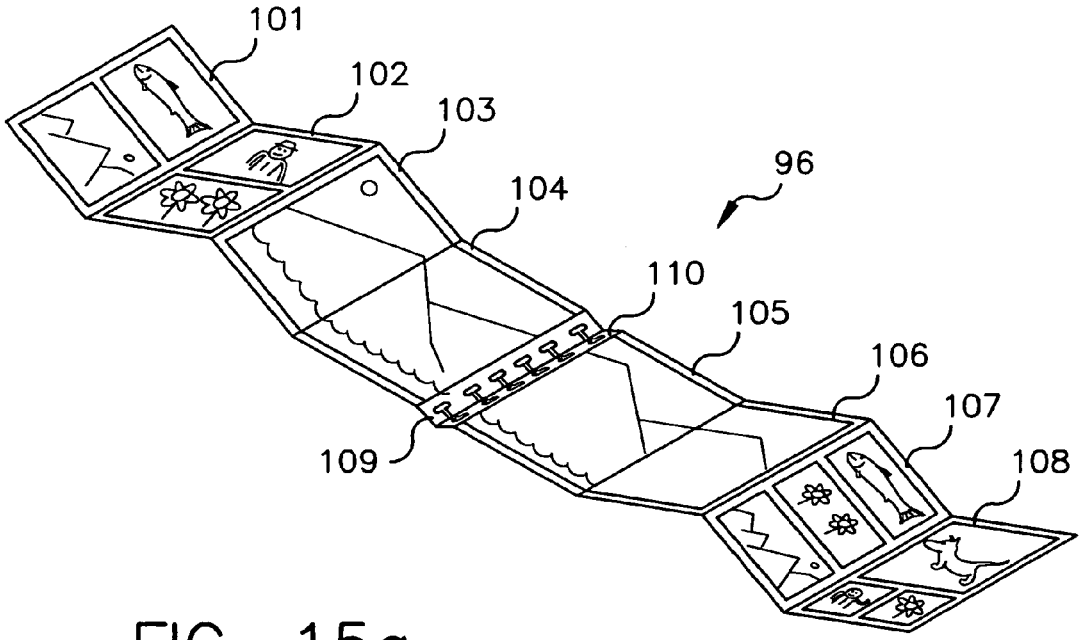
FIGS. 15*a*–15*e* are perspective views which illustrate the sequential steps needed to make and fold a modified composite image product in accordance with the present invention.
Figure 15B:
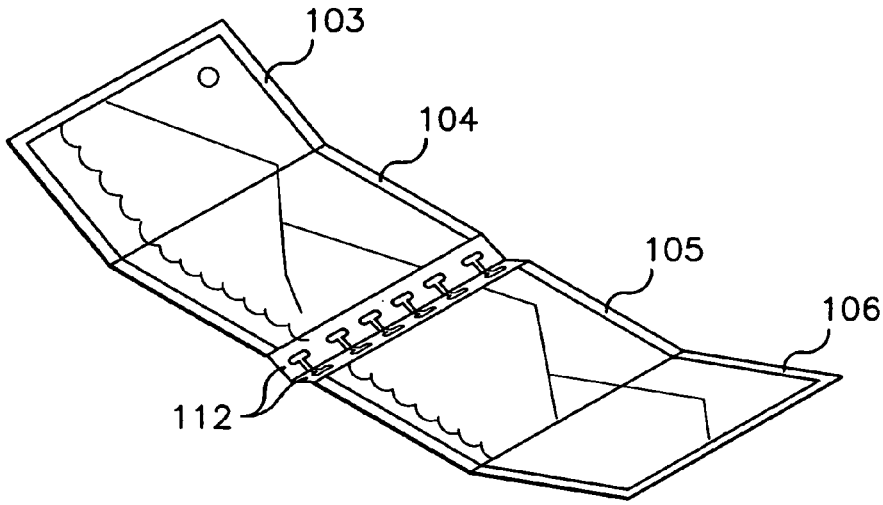
Figure 15C:
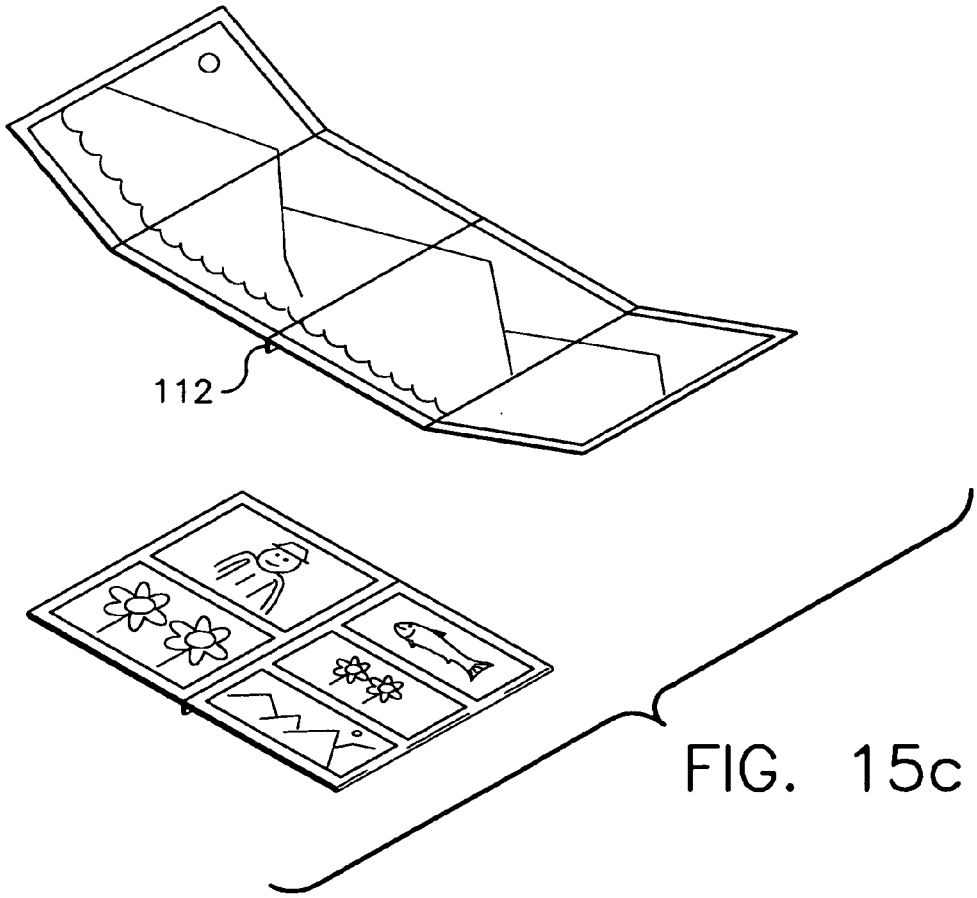
Figure 15D:
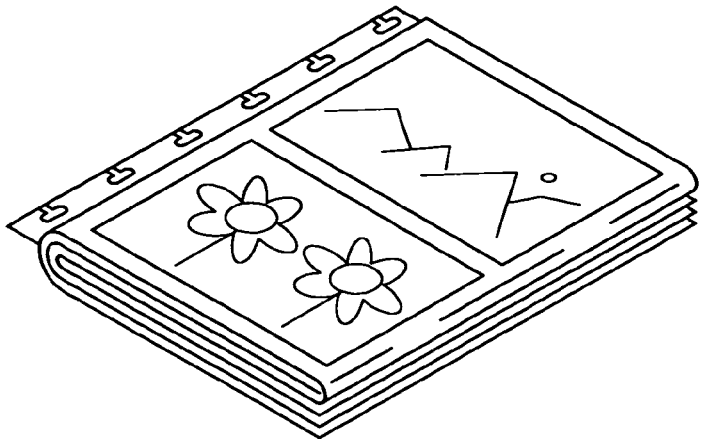
Figure 15E:
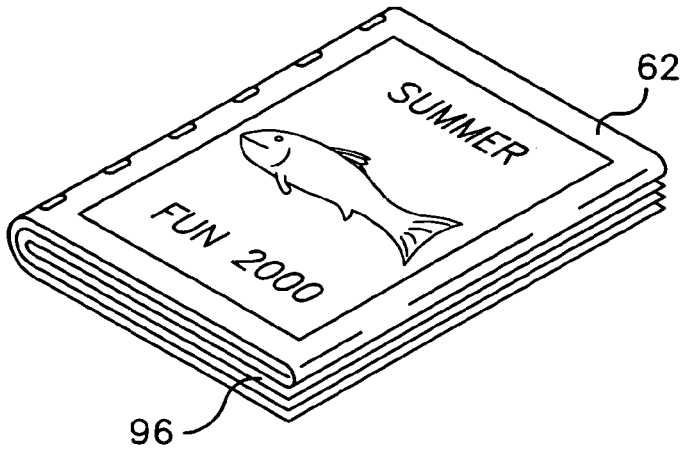

Referring to FIGS. 15*a*–15*d*, there is illustrated yet another integral composite image product 96 made in accordance with the present invention like numerals indicating like parts and operation as previously discussed. FIG. 15*a* illustrates a printed media having images 16 printed on one side. This media can be produced by normal printing techniques whereby a plurality of images 16 are provided on web which is then cut to the appropriate length. Preferably, the media is produced by digital printing techniques such that images can be properly composed thereon taking into account how the image product 96 is to be folded. In the particular embodiment illustrated, the image product 96 is divided into 10 sections 101, 102, 103, 104, 105, 106, 107, 108, 109, and 110. Sections 101–108 have images 16 formed thereon whereas sections 109 and 110 do not and will be used to form an attachment section 112 by which the image product 96 is secured to an album cover 62. FIG. 15*b* illustrates the media of 15*a* folded so as to form product substrates 12 and 14. In particular, sections 101 and 102 are folded against sections 103 and 104 whereas sections 105 and 106 are folded against sections 107 and 108. The folded sections are secured in any appropriate manner, for example but not by way of limitation, by the application of an adhesive between the sections to be secured together. Thereafter as illustrated by FIG. 15*c*, the sections 109 and 110 are secured together in a similar manner to attachment section 112. FIG. 15*d* shows image product 96 in a first folded condition prior to closing. FIG. 15*e* shows image product 96 in its fully folded, closed condition mounted in a closed album cover 62.

Figure 16A:
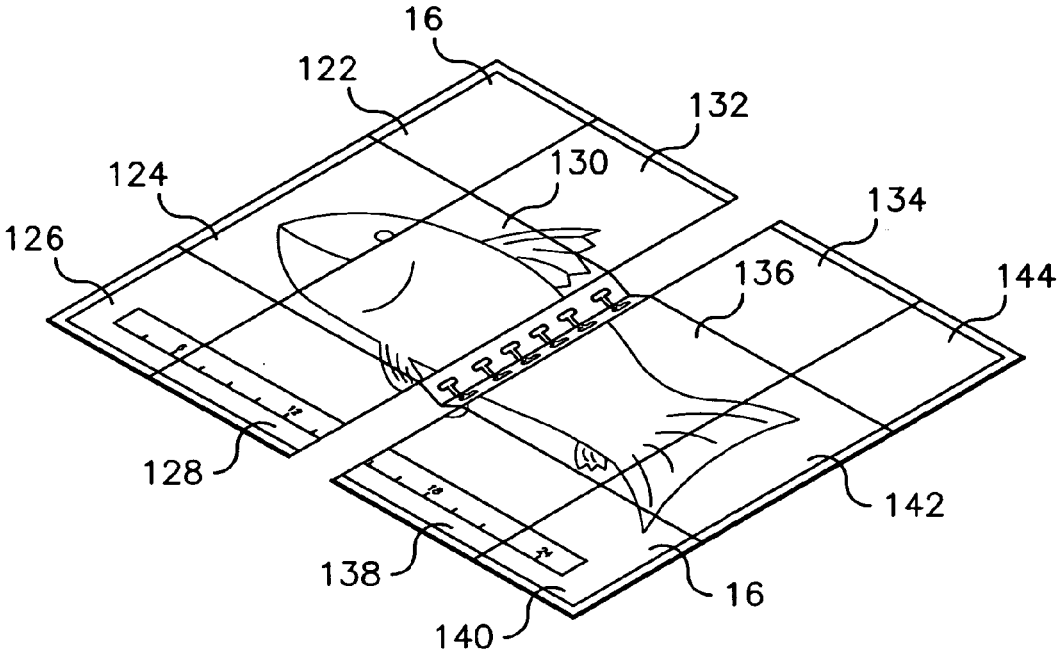
FIGS. 16*a*–16*e* are perspective views which illustrate the sequential steps need to make and fold another composite image product in accordance with the present invention.
Figure 16B:
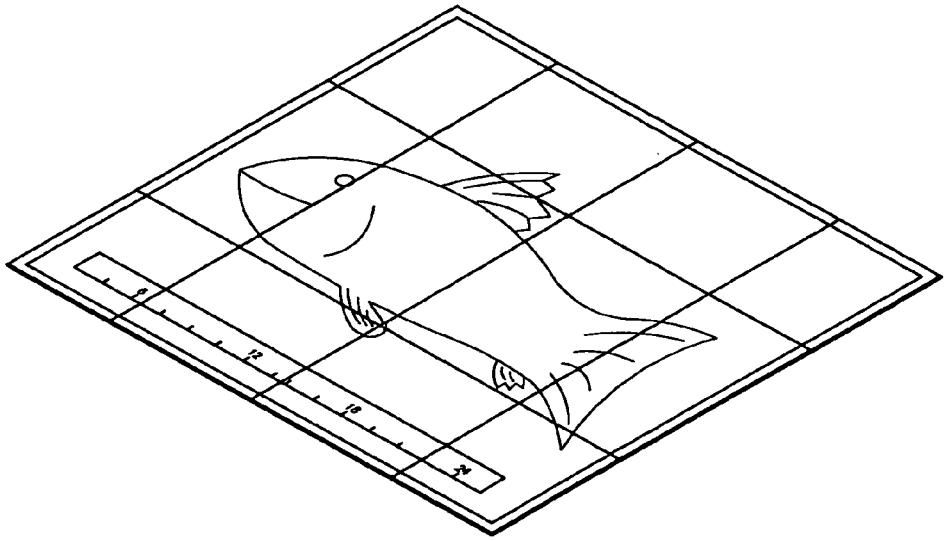
Figure 16C:
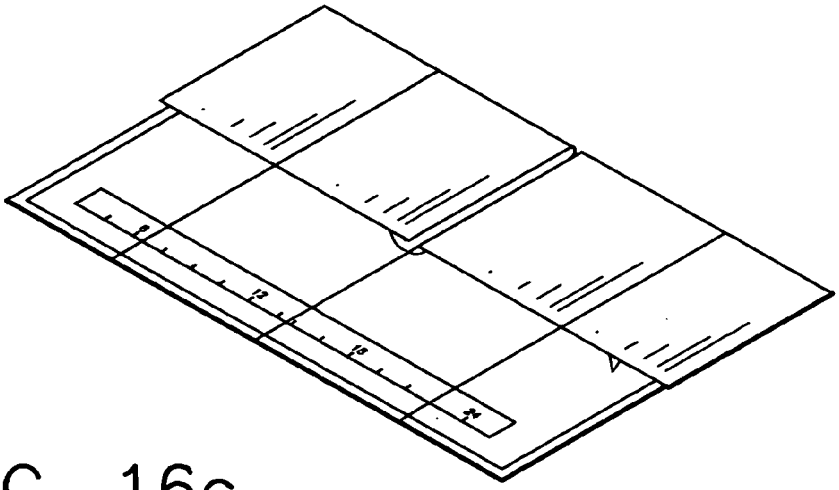
Figure 16D:
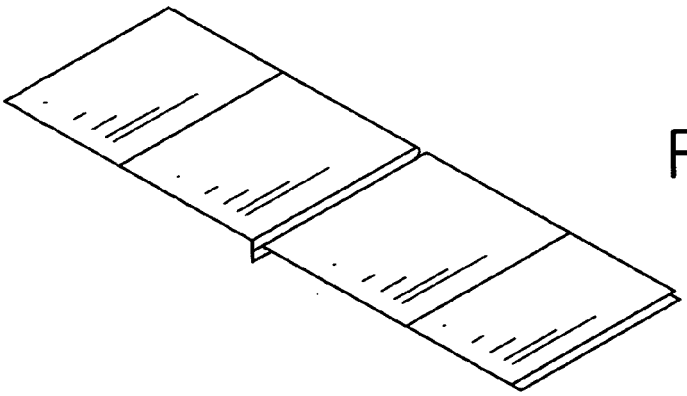
Figure 16E:
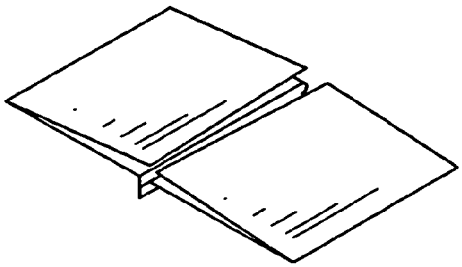

Referring to FIGS. 16*a*–16*c*, wherein yet another modified image product 120 made in accordance with the present invention like parts indicating like parts and operation as previously discussed. The image product 120 is similar to image product 96 except there is a different folding pattern. In this embodiment, a smaller attachment section 112 is provided. Image product 120 includes image sections 122, 124, 126, 128, 130, 132, 134, 136, 138, 140, 142, and 144, and attachment sections 146 and 148. Images 16 are preferably provided on both sides of sections 122 through 144. Attachment section 112 is formed in the same manner as with image product 96. FIGS. 16*b*–16*d* illustrate the sequence of folding the image product 120.

It is of course of understood that any desired folding pattern may be used to provide an expanded unfolded image product.

It is understood that various modifications may be made apart from the scope of the invention. The present invention being defined as by the following claims.

What is claimed is:

1. A dual sided continuous non-interrupted integral composite image product, comprising:

a continuous non-interrupted support substrate comprising:

first and second sections, each section having a first continuous non-interrupted support substrate portion having a front side and a back side, said front side having a separate image layer thereon;

a second continuous non-interrupted support substrate portion having a front side and a back side, said front side having a separate image layer thereon, said back side of said second continuous non-interrupted support substrate portion being permanently secured to said back side of said first continuous non-interrupted support substrate portion so as to form a dual sided continuous non-interrupted integral composite image product; said dual-sided continuous non-interrupted integral composite image product having a fold line about which said dual-sided continuous non-interrupted integral composite image product may be folded and which extends across said image layer; and an attachment section integrally formed with said first and/or second continuous non-interrupted support substrate portions for attaching said dual sided continuous non-interrupted integral composite image product to an album cover.

2. A dual sided continuous integral composite image product, comprising:

a continuous non-interrupted support substrate comprising:

first and second sections, each section having a first continuous non-interrupted support substrate portion having a front side and a back side;

a second continuous non-interrupted support substrate portion having a front side and a back side, said front side having a separate image layer thereon, said back side of said second continuous non-interrupted support substrate portion being permanently secured to said back side of said first continuous non-interrupted support substrate portion so as to form a dual sided continuous non-interrupted integral composite image product; said dual-sided continuous non-interrupted integral composite image product having a fold line about which said dual-sided continuous non-interrupted integral composite image product may be folded and which extends across said image layer; and an attachment section integrally formed with said first and/or second continuous non-interrupted support substrate portions for attaching said dual sided continuous non-interrupted integral composite image product to an album cover.

* * * * *